United States Patent [19]

Beard

[11] Patent Number: 4,537,256

[45] Date of Patent: Aug. 27, 1985

[54] SONIC FRACING PROCESS AND MEANS TO CARRY OUT SAID PROCESS

[76] Inventor: Franklin Beard, 2900 Wilcrest, Houston, Tex. 77079

[21] Appl. No.: 503,595

[22] Filed: Jun. 13, 1983

[51] Int. Cl.[3] ..... E21B 43/26

[52] U.S. Cl. ..... 166/299; 166/308; 166/63; 166/177

[58] Field of Search ..... 166/177, 249, 299, 308, 166/63

[56] References Cited

U.S. PATENT DOCUMENTS

| | | | |
|---|---|---|---|
| 2,871,943 | 2/1959 | Bodine, Jr. | 166/177 |
| 3,016,095 | 1/1962 | Bodine | 166/177 |
| 3,174,545 | 3/1965 | Mohaupt | 166/299 |
| 3,189,092 | 6/1965 | Bodine | 166/177 |
| 3,848,674 | 11/1974 | McColl | 166/177 |
| 3,981,624 | 9/1976 | Brandon | 166/177 |
| 3,990,512 | 11/1976 | Kuris | 166/249 |
| 4,022,275 | 5/1977 | Brandon | 166/249 |

*Primary Examiner*—Stephen J. Novosad
*Assistant Examiner*—William P. Neuder
*Attorney, Agent, or Firm*—Ranseler O. Wyatt

[57] ABSTRACT

A sonic fracing process and means to enhance production of oil and gas wells, increasing formation permeability by creating sonic waves that cracks and loosens the formation interstices. The sonic waves are created by a series of directed detonations and harmonic pulsations. The explosive material is placed inside the well bore and detonated from the surface. Two methods commonly used to increase formation permeability are known as Acidizing and/or Hydraulic Fracturing. The Sonic Frac has been designed to complement these fracing processes.

Three inherent benefits are derived by using the Sonic Frac Process. First, and most important, is that the fine formation fissures are cracked and "opened" to allow flow of oil or gas to migrate from pores that would otherwise not be affected by conventional fracing processes. Second the pressure pulsations, which are created by the expansion of the gas utilized in conjunction with the Sonic cause the fluid in the wall bore to oscillate through the perforated zones. Third, the head generated by the variable velocities of the sonic waves tend to dissipate and precipitate back into the formation any paraffin or asphaltum deposits which might be clogging the perforations or a main artery of permeability.

The device employed includes a tubular housing, cylinders mounted in said housing, pistons in said cylinders, fuel lines connected into said cylinders and a remote controlled firing means in said cylinder, and means for timing the firing so that a series of explosions provide sonic waves in the formation.

4 Claims, 1 Drawing Figure

SONIC FRACING PROCESS AND MEANS TO CARRY OUT SAID PROCESS

SUMMARY OF THE INVENTION

A sonic fracing process for increasing production of oil and gas wells in chalk formations, and the like, wherein sonic waves are produced in gradual, preselected increased intensity, in series of three each, in a well casing adjacent a production formation, that has been previously fraced, the means having a cylindrical housing for lowering into the well casing to a production formation, and positioned adjacent the perforated area of the casing. The housing having a plurality of cylinders mounted therein, with pistons in said cylinders, and fuel lines leading to said cylinders from the ground surface; timers on each cylinder to selectively fire the fuel therein and purge and reload the cylinders. Each cylinder has a mixing chamber adjacent thereto in which fuel is mixed prior to injection into the combustion chamber of the cylinder, and each piston has reseating means to maintain same at the desired position after firing.

BACKGROUND OF THE INVENTION

Nitroglycerins, whether in gelatin or liquid form were used for many years to facilitate explosive fracturing. It was placed in an uncased well bore and detonated. However, the obvious disadvantages of using Nitroglycerin, due to its instability, are numerous. It is extremely shock sensitive, and difficult to transport and handle. Therefore it could not be pumped or poured into the well bore, and thus it had to be carefully placed in the well. There is always the risk of premature detonation as well as collapsing the formation. It has been estimated that thousands of potentially productive wells were ruined by using Nitroglycerin.

To overcome the drawbacks of using Nitroglycerin, experimentation with other liquid explosives and slurry explosives (solid explosives suspended in water or oil) were conducted. It was falsely believed that these explosives could be pressurized into the formation and the resulting explosion would not only frac the formation but would create a large cavity that would allow the fluid in the formation to flow freely to the well bore cavern. In general, these explosives were not successful for reasons, including instability, segregation of constituents, detonation inconsistencies under pressurization, and vulnerability to dilution of the explosive by the fluids in the well bore.

The basic principle of creating a cavity in low permeable formations by using explosives was widely accepted by engineers throughout the oil industry. In the late 1950's experiments were conducted in wells in West Virginia where thousands of pounds of TNT were placed in the well bore and detonated. In 1964, proponents of explosive fracturing were quite seriously suggesting that Thermo-Nuclear devices could be placed in tight formations and detonated in order to create a very large cavity whereby many wells in a given field would be affected.

The postulations formulated concerning increasing explosive components to enhance the fracing process did not take into consideration the viscous and thermal effects of the sonic waves that are propagated. A large explosion is likely to do more harm than good in a given formation due to the shattering and fragmation that occurs.

In order to achieve the optimum results in explosive fracturing, it is imperative that the intregity of the formation is not substantially altered. This premise is actually the foundation of this Sonic Frac Process.

DESCRIPTION OF THE PREFERRED EMBODIMENTS

Figure 1:
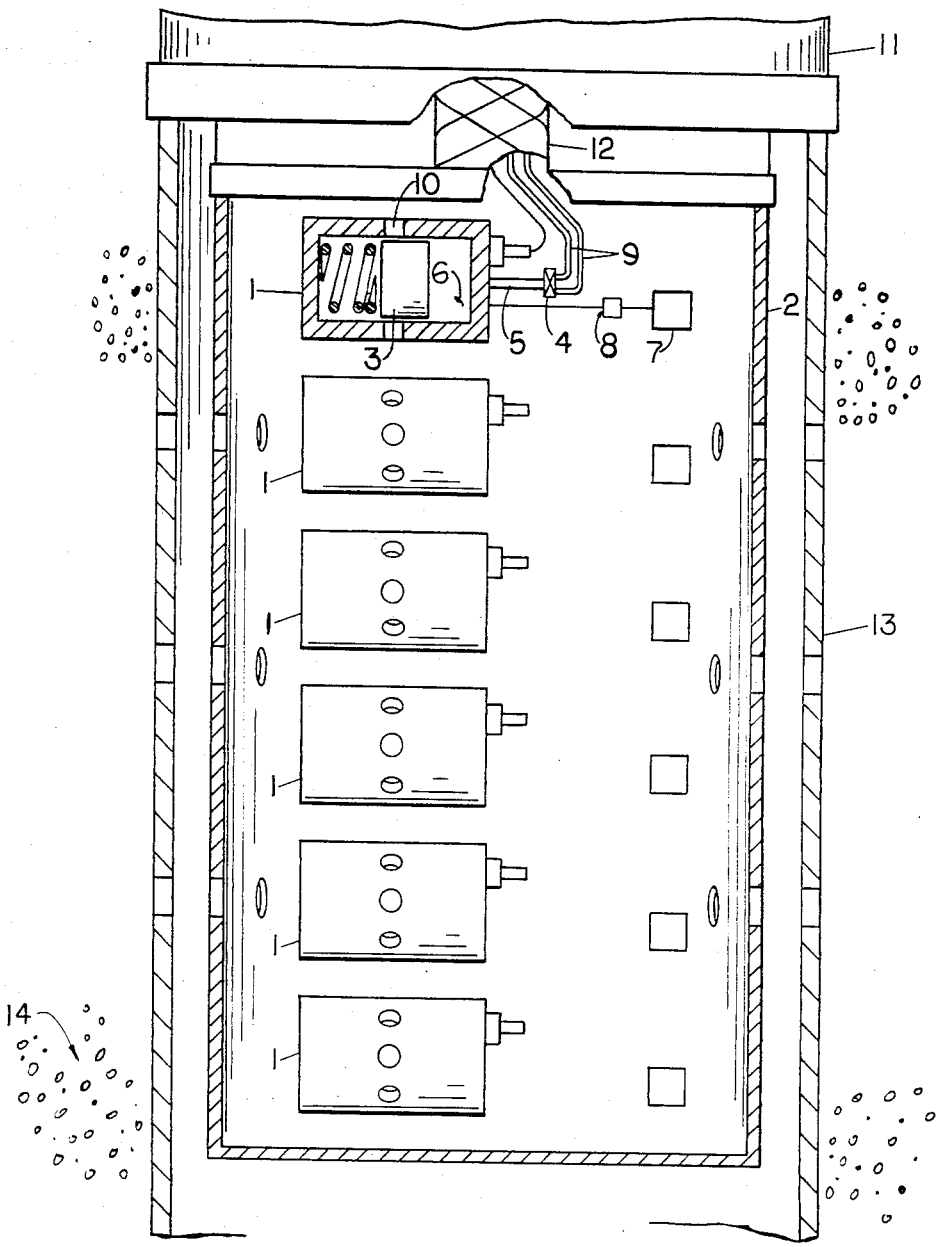
FIG. 1 is a diagrammatic sketch of the means employed.

In the drawing, the numerals 1,1 designate cylinders mounted in a tubular housing 2, in series, having pistons 3 reciprocally mounted in said cylinders, and means for yieldably maintaining said pistons in a centered position in said cylinders. A fuel mixing chamber 4 into which gas combinations or the like are directed, and which passes therefrom through line 5 into the combustion chamber 6 and the residue of which passes out of the cylinder into the formation through the port holes 10, in cylinder 1. A timer 7 controls a solenoid valve 8 which opens and closes to control the flow of fuel to the cylinder and resets the firing mechanism. Firing of the fuel in the cylinder is controlled from the ground surface through the controls 9,9 which may be set for purging the cylinder, after firing, and refilling the cylinder preparatory for another explosion. The housing 2 is lowered into the well casing to perforated production formation area, preferably one that has been previously fraced, and with the housing extending substantially the full length of the perforated area. The first cylinder will be fired, causing an explosion, the shock of which will be transmitted through the ambient fluid into the formation, and after a preselected interval, another cylinder is fired, with a slightly greater shock, and the third firing following being greater than the second. This is followed by another series of three shocks, completing the firing of the cylinders. As each cylinder is fired, the pressure against the piston is sufficient to force the piston downwardly, overcoming the resistance of the spring and of the surrounding hydrostatic pressure, and uncovering the port holes 10, to permit passage of said residue into the ambient fluid, causing a pressure pulse in the formation. Before firing, it is ascertained that the formation and the well casing 11 is filled with water, and as each pulse flows into the formation, the fracing action will occur, and the resulting washing action will open passageways in the formation for the flow of petroleum into the well casing bearing the explosive device, as well as adjacent casings. The force of the respective explosions creates a wave in the formation, which moves outwardly away from the casing until the force of the explosion is exhausted; then the wave returns through the formation to the casing, where it will be met by the next, and greater explosion, creating a greater wave, thus effecting the washing action clearing passageways for the flow of production fluid.

The second series of three explosions repeats the process in a timed circuit. The housing 1 may then be removed from the casing and production accomplished in the usual manner, or, the controls being at the well head, the pistons may be purged and reloaded and as many additional shots fired as desired.

What I claim is:

1. In a formation stimulator, means mountable within a well casing for creating successive sonic waves in a production formation by controlled explosions in measured series said means for creating sonic waves has a housing, a plurality of cylinders within said housing, reciprocable pistons in said cylinders, means for introducing fuel into said cylinders, port holes in said cylinders through which exhaust gases from said fuel pass into the formation when said fuel has been ignited and said pistons are in one position.

2. In a formation stimulator, means mountable within a well casing for creating successive sonic waves in a production formation by controlled explosions in measured series and said stimulator has a housing in which a plurality of cylinders are mounted, means for mixing and introducing a preselected charge of combustible fuel into each of said cylinders, and means for inducing explosion of said fuel in each of said cylinders at fixed intervals, means for purging said cylinders and recharging same.

3. The method of fracing a production formation, introducing a series of explosions creating a flow of exhaust gas in the well casing opposite a perforated area therein, said gas carrying its thermal properties into the adjacent production formation, said series having three successively greater explosions, creating reciprocating sonic waves in the formation, fracing the formation and forming passageways into the well casing.

4. The method defined in claim 3 wherein the supply of fuel for said explosions is controlled at ground surface and the number of explosions and the interval between explosions is pre-selected.

* * * * *